US006565915B2

(12) United States Patent
Grobbauer

(10) Patent No.: US 6,565,915 B2
(45) Date of Patent: May 20, 2003

(54) METHOD FOR LACQUERING THE INNER SIDE OF THE DISPLAY SCREEN

(75) Inventor: Robert Grobbauer, Pirka (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/153,257

(22) Filed: May 22, 2002

(65) Prior Publication Data

US 2002/0136827 A1 Sep. 26, 2002

Related U.S. Application Data

(62) Division of application No. 09/575,611, filed on May 22, 2000, now Pat. No. 6,413,316.

(30) Foreign Application Priority Data

May 21, 1999 (EP) ..... 99890164

(51) Int. Cl.[7] ..... B05D 7/22; B05D 1/02

(52) U.S. Cl. ..... 427/64; 427/72; 427/164; 427/165; 427/168; 427/105; 427/106; 427/110; 427/233; 427/236

(58) Field of Search ..... 118/301, 500, 118/503, 306, 317, 318; 427/237, 233, 236, 64, 72, 164, 165, 168, 105, 106, 110

(56) References Cited

U.S. PATENT DOCUMENTS 3,440,081 A * 4/1969 Glovatsky et al. ..... 118/300
3,473,942 A * 10/1969 Magill et al. ..... 427/233
6,103,297 A * 8/2000 Aoki et al. ..... 427/72

* cited by examiner

*Primary Examiner*—Shrive P. Beck
*Assistant Examiner*—Michael Cleveland

(57) ABSTRACT

In a method for lacquering the inner side of a display screen, a frame is provided to form sealing means for sealing a spacing between a closing means having a passage and closing an inner space of a lacquering head at the top and a display screen covering this passage, in which method an air gap formed between the frame and a peripheral area of a display screen extending substantially parallel to a display screen axis and being bounded by an outer peripheral boundary face constitutes a flow resistance as a result of its dimensions and counteracts the escape of a gaseous medium from the inner space of the lacquering head and through the spacing between a passage boundary face of the passage in the closing means and the outer peripheral boundary face of the peripheral area of a display screen covering the passage in the closing means.

11 Claims, 3 Drawing Sheets

METHOD FOR LACQUERING THE INNER SIDE OF THE DISPLAY SCREEN

CROSS REFERENCE TO RELATED APPLICATIONS

This is a divisional of application Ser. No. 9/575,611, filed May 22, 2000, now U.S. Pat. No. 6,413,316.

FIELD OF THE INVENTION

The invention relates to display screens and display screen construction, and more particularly to devices and methods for lacquering the inner side of a display screen.

BACKGROUND AND SUMMARY OF THE INVENTION

Such a device and method have been used by the applicant for many years and are therefore known. In the known device and in the known method, the sealing means are provided with a frame-shaped flat rubber piece connected to the closing means by way of a connection frame, which flat rubber piece constitutes a sealing lip extending towards the frame-shaped peripheral area of a display screen inserted into the known device, the sealing lip substantially comprising four sealing lip sections and engaging the outer peripheral boundary face of the peripheral area of this display screen. In the known device and method, it is necessary to ensure a preferably exact positioning of the rubber ring and its sealing lip, for which appropriate adjusting measures are required. A further aspect is to be taken into account during permanent operation of the known device because the sealing lip may be contaminated when this is not prevented by suitable cleaning measures. To resist the solvent in practically every lacquer, such as toluene, the use of a solvent-resistant viton rubber for the rubber ring and its sealing lip is essential.

It would be advantageous to provide an improved device and an improved method, in which improved sealing means are used, which prevent the above-mentioned difficulties in a simple and low-cost manner.

Accordingly, in one aspect of the invention, a method of lacquering the inner side of a display screen having a front area that extends substantially transverse to a display screen axis, and a peripheral area remote from the front area and extends substantially parallel to the display screen axis, the peripheral area being bounded by an outer peripheral boundary face, comprises: positioning the display screen at a lacquering head that encloses an inner space and is closed at the top with a closing plate that has a passage bounded by a passage boundary face and can be covered by the display screen while leaving free a spacing between the passage boundary face of the passage in the closing plate and the peripheral area of the display screen covering the passage in the closing plate, and through which passage the inner side of a display screen can be lacquered; providing the lacquering head with a support with which a display screen covering the passage in the closing plate can be axially supported, and in whose inner space lacquer-supply passage can be inserted; providing the lacquering head with a sealing structure that seals the spacing; bringing the peripheral area of the display screen is into proximity of the passage in the closing plate of the lacquering head; axially supporting the display screen in a lacquering position by the support of the lacquering head, in which position the display screen substantially covers the inner space of the lacquering head; and after the display screen has reached its lacquering position, supplying lacquer via the lacquer-supply passage to lacquer the inner side of the display screen, during which lacquering operation a gaseous medium is released in the inner space of the lacquering head, and escape of the released gaseous medium from the inner space of the lacquering head is counteracted by the sealing structure with which the lacquering head is provided. While positioning the display screen at a lacquering head, the peripheral area of the display screen is being brought into the proximity of the passage in the closing plate of the lacquering head, an air gap present between an inner frame boundary face of a frame and an outer peripheral boundary face of the peripheral area of the display screen is formed between the peripheral area of the display screen and the frame associated with the sealing structure and being bounded by the inner frame boundary face, the air gap constituting a flow resistance as a result of its dimensions and counteracting the escape of the released gaseous medium from the inner space of the lacquering head.

With the invention, an essentially simpler device is obtained in which sealing means realized in a very simple manner and yet being very effective are provided, in which with relatively little maintenance, the desired object is achieved, which is of great advantage for a high capacity utilization of a device according to the invention. The sealing means are advantageously realized without mechanical contact with the display screen present proximate to the lacquering head, which is very advantageous with a view to realizing a longer lifetime and avoiding an unwanted contamination. The air gap formed by means of the frame advantageously represents a uniformly effective flow resistance which counteracts an escape of a gaseous medium, such as toluene, from the inner space of the lacquering head in each air gap area with the same resistance, which is very advantageous for a spatial and temporally homogeneous drying of the lacquer on the inner side of the display screen.

One embodiment of the invention, described herein, yields the advantage that the display screen to be lacquered, inserted into the frame and axially supported, can be very accurately positioned transversely to the display screen axis, so that an equal width of the air gap along the entire outer peripheral boundary face of the peripheral area of the display screen is ensured.

Some embodiments of the invention may be equipped, for example, with a frame having an inner frame boundary face whose longitudinal extension extending parallel to the display screen axis is smaller than the extension, extending substantially parallel to the display screen axis, of the outer peripheral boundary face of the peripheral area of the display screen. Likewise, a device according to the invention may be equipped, for example, with a frame having an inner frame boundary face, whose longitudinal extension extending parallel to the display screen axis is larger then the extension, extending substantially parallel to the display screen axis, of the outer peripheral boundary face of the peripheral area of the display screen. In both cases, a desired flow resistance of the air gap can be achieved by a corresponding choice of its dimensions.

An embodiment of the invention described herein advantageously provides an air gap between the inner frame boundary face of the frame and the outer peripheral boundary face of the peripheral area of each display screen to be lacquered. It has further proved to be very advantageous when an end zone of the frame bounding the inner frame boundary face of the frame at its end remote from the closing means and an end zone of the display screen bounding the outer peripheral boundary face of the peripheral area of the display screen covering the passage in the closing means at its end remote from the closing means are substantially situated in a plane extending transversely to the display screen axis of the display screen. Apart from positioning, alignment and dimensioning of the inner frame boundary face of the frame, it may also be noted that the inner frame boundary face of the frame may have a completely smooth surface, but also a surface structure which is completely or partly roughened or is uneven so as to obtain a desired flow resistance.

In an embodiment of the invention described herein, to ensure mechanical stability the frame has a dimension extending transverse to its inner frame boundary face that substantially corresponds to the longitudinal extension, extending parallel to the display screen axis, of the inner frame boundary face of the frame. Furthermore, the provision of this feature has a positive influence on the flow resistance of the air gap, because turbulent air streams, which may possibly occur during rotation of the lacquering head in an area of an outer edge of the frame and may lead to air pressure differences along each outer edge of the frame, are inhibited by the side of the air gap facing the front area of the display screen.

In an embodiment of the invention described herein, the frame has a substantially rectangular cross-section. This has proved to be very advantageous because it ensures a very simple possibility of manufacturing the frame.

In an embodiment of the invention described herein, to provide easy insertion and prepositioning of each display screen, the side of the frame remote from the closing means has an inlet chamfer blending with the inner frame boundary face.

In an embodiment of the invention described herein, the side of the frame facing the closing means has an outlet chamfer blending with the inner frame boundary face. In this way a lasting contamination of the air gap with lacquer residues is avoided during lacquering of the display screen, so that the air gap remains free from contaminations and the sealing property of the air gap is maintained so that a longer and maintenance-free use of the frame in the device is possible.

In an embodiment of the invention described herein, the frame has at least one recess which is accessible from the outer side of the frame and is provided to retain the frame. This provides the possibility of a simple manual or machine-operated manipulation of a frame, when applying the frame to the lacquering head and when removing the frame from the lacquering head, as is done, for example, when a frame is replaced.

In an embodiment of the invention described herein, a quick-release connection provides the possibility of simple and rapid fixation and detachment of the frame onto and from the closing means without having to use additional auxiliary means.

In an embodiment of the invention described herein, the frame is made of a solvent-resistant material. This avoids an environmentally unfriendly and frequent waste of the frame and thus ensures an optimum environmentally friendly utilization of material resources and an economically efficient operation of the device according to the invention.

BRIEF DESCRIPTION OF THE DRAWING FIGURES

DETAILED DESCRIPTION

Figure 1:
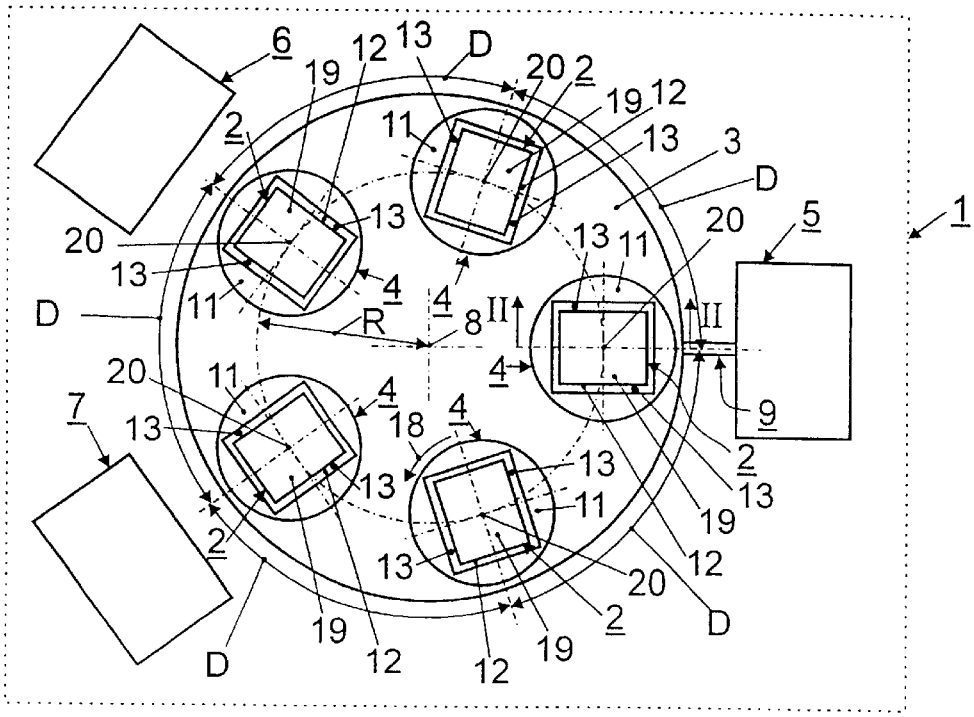
FIG. 1 shows diagrammatically a plan view of a device in accordance with a first embodiment of the invention.

FIG. 1 shows a device 1 for lacquering a display screen 2 for a display tube, such as a monitor. The device 1 has a circular table 3 and five lacquering heads 4 connected to the circular table 3, as well as a lacquering station 5 and a display screen manipulation station 6 and a display screen pre-treatment station 7. The device 1 has five identical lacquering heads 4 arranged on the circular table 3 at a radial distance R from a center 8 of the circular table 3 and with identical angle distances D. FIG. 1 also shows five closing means 11 closing one lacquering head 4 each. Each closing means 11 is constituted by a disc-shaped closing plate which is connected to the relevant lacquering head 4.

Each lacquering head 4 of the device 1 has a synthetic material frame 12 associated with the closing means 11 of the relevant lacquering head 4. Each frame 12 is secured by means of two quick-release connections 13 (shown only diagrammatically in FIG. 1) to the associated closing means 11. Each frame 12 covers with its inner area a substantially rectangular passage 14 in the closing means 11, so that the effective passage cross-section through each closing means 11 is reduced in this way.

Figure 2:
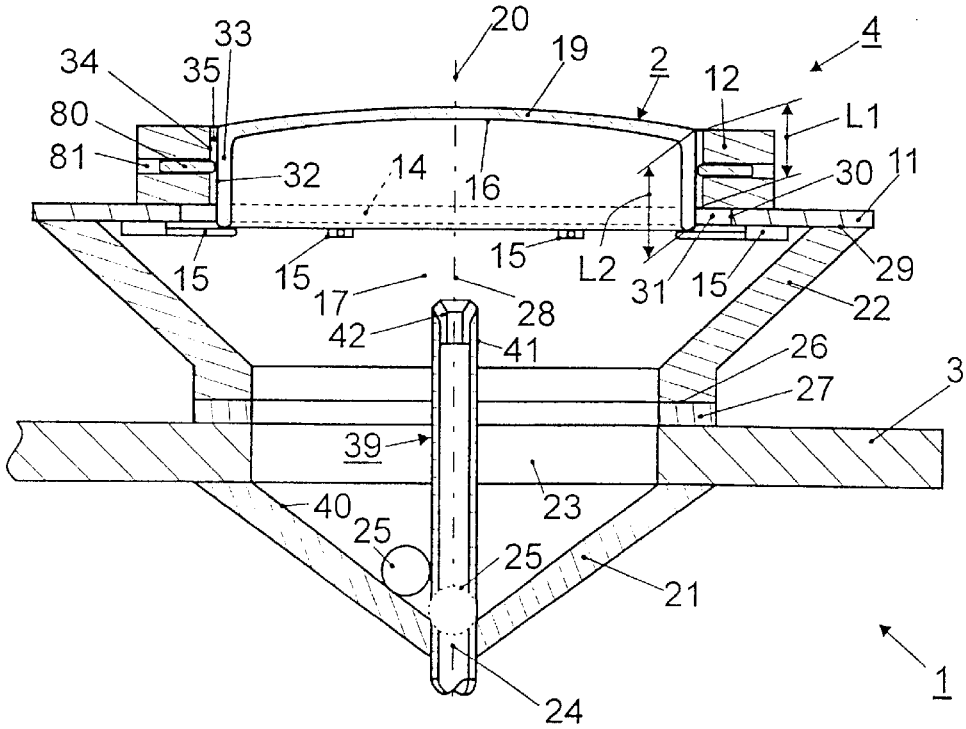
FIG. 2 is a cross-section, taken on the line II—II in FIG. 1, of a part of the device shown in FIG. 1.

A multitude of display screens 2 to be lacquered is consecutively supplied by auxiliary means (not shown) to the display screen manipulation station 6 and inserted on supporting means 15 by means of manipulation aids (not shown) of the display screen manipulation station 6 through the free passage in each frame 12, as is shown in FIG. 2. The supporting means 15 axially support each display screen 2 in a position within the frame 12, so that an inner side 16 of a display screen 2 to be lacquered is accessible from an inner space 17 of a lacquering head 4.

A display screen 2 supported in the above-mentioned way is brought to a display screen pre-treatment position by rotating the circular table 3 through the angle distance D in the proximity of the display screen pre-treatment station 7 where it is subjected to a pre-treatment. A display screen 2 to be lacquered is pre-wetted on its inner side 16 with a pre-wetting agent during the pre-treatment.

By rotating the circular table 3 through another angle distance D, a pre-wetted display screen 2 to be lacquered can be brought to an intermediate position succeeding the pre-treatment position and preceding the lacquering position. In this intermediate position, the lacquering head 4 is rotatable in the direction of the arrow 18 by means of drivers (not shown in FIG. 1), and this with respect to a display screen axis 20 extending substantially transversely to a front area 19 of a display screen 2 to be lacquered. Due to this rotation, the previously provided pre-wetting agent is homogeneously spread on the inner side 16 of the display screen 2 to be lacquered.

By rotating the circular table through another angle distance D, a display screen 2 to be lacquered is moved into the direct proximity of the lacquering station 3, in which the display screen 2 assumes a lacquering position in which a lacquering process is possible. Lacquer for lacquering the inner side 16 of a display screen 2 can be supplied via a tube-like connection 9 from the lacquering station 3 to the lacquering head 4 in its lacquering position.

After a lacquering process for a display screen 2 has been completed, the circular table 3 is rotatable by another angle distance D so that the display screen 2 can be brought to a further intermediate position preceding the display screen manipulation station 6, in which position the rotational speed of the rotating lacquering head 4 is reduced until it comes to a standstill. By subsequent further rotation of the circular table through the angle distance D, the display screen 2, which has already been lacquered, can be brought into the direct proximity of the display screen manipulation station 6 from which a display screen 2, which has now been lacquered, can be taken from the frame 12 of a lacquering head 4 by manipulation means (not shown) of the display screen manipulation station 6 and removed by a means (not further shown) from the display screen manipulation station 6.

The display screen 2 lacquered on its inner side 16 and dried is applied in a further manufacturing process to a device for aluminizing its inner side 16, which is done by vapor deposition of aluminum. Such an aluminizing device is often referred to by those skilled in the art as alu-mill.

FIG. 2 shows a part of a device 1, in which a display screen 2 inserted into a lacquering head 4 and to be lacquered assumes a lacquering position. The lacquering head 4 consists of a lacquering head part 21 remote from the display screen 2 and situated at a further distance from the display screen 2 with respect to the circular table and a lacquering head part 22 facing the display screen 2 and being nearer to the display screen 2 with respect to the circular table 3. The lacquering head part 21 which is further away from the display screen 2 has a conical shape. The lacquering head part 21 terminates in a circular passage 23 provided in the circular table 3. At the other end, the conical lacquering head part 21 is bounded by a cone end aperture 24 which is circular in cross-section. A ball 25 is provided as a closing means in the inner space 17 of the lacquering head 4, which ball has a larger diameter than the conical end aperture 24 and can reach a closing position, shown by way of a broken line in FIG. 2, under the influence of gravity, thus ensuring a closure of the conical end aperture 24. It is to be noted that a lacquering head 4 may alternatively consist only of a conical lacquering head part 22 which is near the display screen 2, while omitting a lacquering head part remote from the display screen 2, which lacquering head part 22 has a circular aperture in the area of its conical tip, which aperture can be closed by means of a ball 25.

Bearing means 27 are provided, allowing rotation on the lacquering head part 22 at contact surface 26 through an axis 28 extending perpendicularly to the circular table 3 and coaxially to the circular passage 23. The axis 28 extends coaxially to the display screen axis 20. The lacquering head part 22 which is proximate to the displaced screen 2 is closed by the closing means 11 at its end remote from the circular table 3, thus at the top 29 of lacquering head part 22. The closing means 11 closing the lacquering head 4 at the top has a passage 14 which is bounded by a frame-shaped passage boundary face 30 and can be covered by a display screen 2 to be lacquered while leaving free a spacing 31 between the passage boundary face 30 of the passage 14 in the closing means 11 and a similarly frame-shaped outer peripheral boundary face 32 of a peripheral area 33, extending substantially parallel to the displaced screened axis 20, of the display screen 2 covering the passage 14 in the closing means 11, and through which passage the inner side 16 of the displaced screen 2 can be lacquered. The frame-shaped passage boundary face 30 consists of four passage boundary face sections. The square-shaped peripheral boundary face 32 analogously consists of four peripheral boundary face sections.

The display screen 2 to be lacquered rests on the supporting means 15 of the lacquering head 4 provided on the side of the closing means 11, facing the circular table 5, in the inner space 17 of the lacquering head 4, which supporting means 15 axially support the display screen 2. On the side of the closing means 11 remote from the inner space 17 of the lacquering head 4, the lacquering head 4 has a construction with the aid of which sealing means are realized. For realizing the sealing means, the lacquering head 4 is provided with a frame 12 in the area of its closing means 11. The frame 12 has a frame-shaped inner frame boundary face 34 which consists of four frame boundary face sections and is provided to surround the outer peripheral boundary face 32 of the peripheral area 33 of the display screen 2 covering the passage 14 in the closing means 11. By surrounding the outer peripheral boundary face 32 of the peripheral area 33 of a display screen 2 covering the passage 14 in the closing means 11 with the inner frame boundary face 34 of the frame 12, an air gap 35 is formed which constitutes a flow resistance as a result of its dimensions. The width of the air gap 35, i.e. its radial dimension, is in a range between 0.5 mm and 2.5 mm, preferably between 1 mm and 2 mm at a nominal value of 1.5 mm. The height of the outer peripheral area 33 of a display screen 2 is about 38 mm for a 15-inch display screen and about 42 mm for a 17-inch display screen, which height is smaller than 38 mm for display screens which are smaller than 15 inch and larger than 42 mm for display screens which are larger than 15 inch. It is therefore sensible that different heights of the outer peripheral area 33 are given for different display screen types so that, accordingly, a variation of an axial dimension of the height of the air gap 35 should also be given. In the relevant case for 15-inch and 17-inch display screens, the height of the air gap 35 is thus 38 mm and 42 mm, respectively. Ideally, the height of the air gap 35 is thus adapted to the height of a display screen 2.

Per frame side, i.e. per frame boundary section, the frame 12 has at least one opening 81. The openings 81 extend transversely to the frame boundary face 34 and completely penetrate the frame 12. Each opening 81 comprises a radial spacer. The radial spacers are formed as threaded bolts 80 in this case, accommodated in the openings 81 which are threaded. The threaded bolts 80 are provided at their ends remote from a display screen 2 with a slit (not shown) for screwing purposes. At their ends facing a display screen 2, the threaded bolts 80 are adapted to co-operate with a section of the outer peripheral boundary face 32 of the peripheral area 33 of a display screen 2. The co-operation of all threaded bolts 80 with the peripheral area 33 is effected in such a way that each threaded bolt 80 can be contacted with the peripheral boundary face 32 by way of screwing, so that the display screen 2 can be positioned in a plane, extending transversely to the display screen axis 20, within the inner frame boundary face 34 of the frame 12. The possibility of positioning the display screen 2 ensures a uniform width of the air gap 35 along the entire outer peripheral boundary face 32. It is to be noted that radial spacers for co-operation with the peripheral area 33 of a display screen 2 are not necessarily to be connected to the frame 12, but may be alternatively connected to the closing means 11 or to the supporting means 15 or to the lacquering head part 22. Furthermore, it is to be noted that the radial spacers may also be formed as positioning pins inserted into openings 81 in the frame 12.

The inner frame boundary face 34 of the frame 12 preferably has a longitudinal extension L1 extending parallel to the display screen axis 20 of a display screen 2 covering the passage 14 in the closing means 11, which longitudinal extension determines the height of the air gap 35. The longitudinal extension L1 of the frame 12 substantially corresponds to the extension L2, extending parallel to the display screen axis 20, of the outer peripheral boundary face 32 of the peripheral area 33 of a display screen 2 covering the passage 14 in the closing means 11, in which the longitudinal extension L1 in the device 1 as shown in FIGS. 1 and 2 is slightly shorter than the longitudinal extension L2.

With reference to the device 1 shown in FIGS. 1 and 2, it is to be noted that the frame 12 has a dimension L3 extending transversely to its inner frame boundary face 34. In the relevant case, this dimension L3 is advantageously chosen to be such that it corresponds to the longitudinal extension L1 of the inner frame boundary face 34 of the frame 12 extending substantially parallel to the display screen axis 20, in other words, the frame 12 has a quadratic cross-section which, with a view to a high stability, has proved to be advantageous.

When lacquering the inner side 16 of a display screen 2 covering the passage 14 in the closing means 11, which display screen is retained by the lacquering head 4 which is present in its lacquering position, the ball 25 is removed from its position closing the conical end aperture 24 shown by way of a broken line in FIG. 2, by introducing a lacquer-supply means 39 into the inner space 17 of the lacquering head 4, with the ball 25 coming to rest between the lacquer-supply means 39 and the side wall 40, facing the inner space 17 of the lacquering head 4, of the lacquering head part 21 remote from the display screen. In the device 1, the lacquer-supply means 39 has a lacquering gun 41 and a lacquering nozzle 42 positioned on and secured to the lacquering gun 41. Preferably, a so-called T jet nozzle is used as a lacquering nozzle 42 which is adapted to supply a fan jet of lacquer at an aperture angle of 110°. The lacquer-supply means 39 are connected to the lacquering station 3 via a tube-like connection 9 shown in FIG. 1, which lacquering station 3 is adapted in the device 1 to prepare and store the lacquer, as well as to pass on the lacquer to the lacquer-supply means 39.

When lacquering the inner side 16 of a display screen 2 to be lacquered and covering the passage 14 in the closing means 11, the lacquer-supply means 39 activated and inserted into the inner space 17 of the lacquering head 4 supplies lacquer via the lacquering nozzle 42, which lacquer is deposited on the inner side 16 of a display screen 2 and spreads across the inner side 16 of the display screen 2 due to the rotation of the lacquering head part 22 facing the display screen 2 and under the influence of the centrifugal force. The solvent evaporating from the lacquer adhering to the inner side 16 is spread as a gaseous medium in the inner space 17 of the lacquering head 4. An unwanted escape of this gaseous medium from the inner space 17 of the lacquering head 4 and through the spacing 31 between the passage boundary face 30 of the passage 14 in the closing means 11 and the peripheral area 33 of the display screen 2 covering the passage 14 in the closing means 11 is counteracted in a very uniform and effective manner, namely by means of the flow resistance which is constituted by the air gap 35 between the inner frame boundary face 34 of the frame 12 and the outer peripheral boundary face 32 of the peripheral area 33 of the display screen 2 covering the passage 14 in the closing means 11. As regards the air gap 35 and its sealing property, the provision of radial spacers 80 has proved to be very advantageous, because their use ensures a uniform air gap 35, also during the lacquering operation. The provision of radial spacers 80 is particularly advantageous for rotating lacquering heads, because a radial slip of a display screen 2 during rotation is counteracted in this case by the effect of the centrifugal force.

After the lacquer has been supplied, the lacquer-supply means 39 is removed from the inner space 17 of the lacquering head 4 and the ball 25 provided as a shutter means is moved towards the conical end aperture 24 under the influence of gravity, thereby shutting off the conical end aperture 24.

Figure 3:
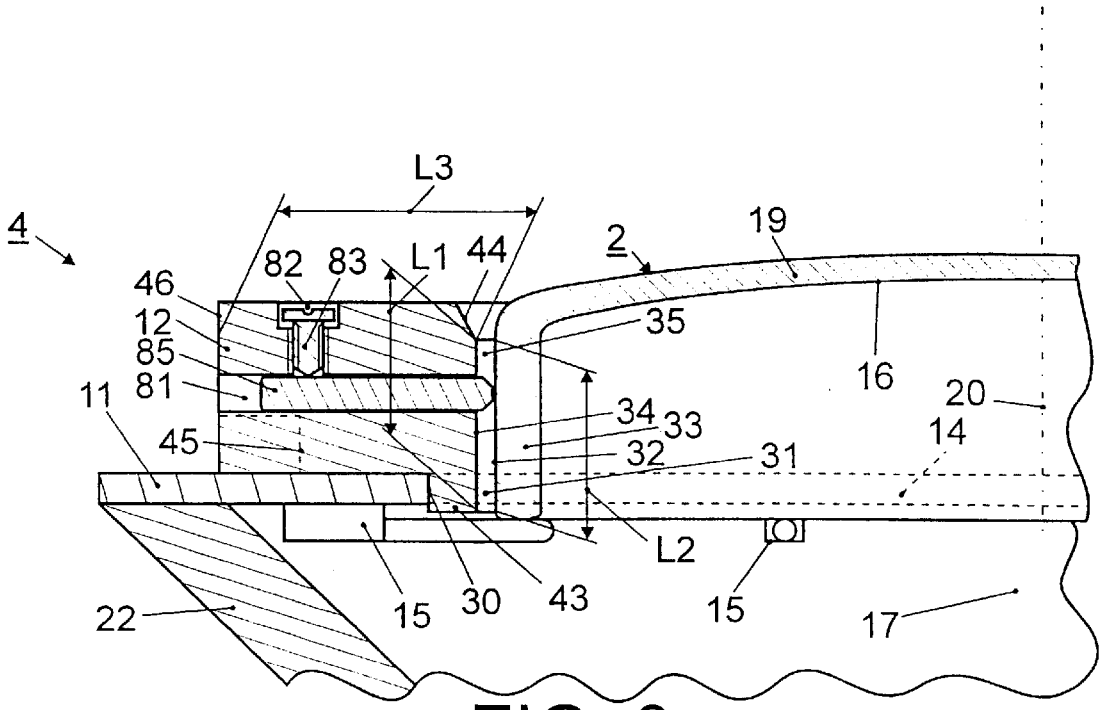
FIG. 3 shows, in analogy with FIG. 2 but on a larger scale, a part of a device in accordance with a second embodiment of the invention.

In the device 1 shown in FIG. 3, the frame 12 has a frame-shaped projection 43 extending from the frame 12 towards the lacquering head 4 and covering the passage boundary face 30 of the passage 14 in the closing means 11. Furthermore, the frame 12 is provided on its side remote from the closing means 11 with an inlet chamfer 44 blending with the inner frame boundary face 34, which inlet chamfer 44 forms a relatively smooth transition between the side of the frame 12 remote from the closing means 11 and the inner frame boundary face 34 of the frame 12. The provision of the inlet chamfer 44 leads to a precise and simple insertion of the display screen in the frame 12. It is to be noted that, in the relevant case, the frame 12 has a dimension L3 extending transversely to its inner frame boundary face 34, which dimension is larger than the longitudinal extension L1 of the inner frame boundary face 34 of the frame 12, so that the frame 12 has an essentially rectangular cross-section, which is also favorable with a view to a high mechanical stability. The frame 12 is provided with recesses 45 which are accessible from the outer side of the frame 12. The recesses 45 are spread along an outer frame boundary face 46 of the frame 12 and preferably adjacent to the closing means 11 and possibly symmetrically with respect to the display screen axis 20. The recesses 45 are adapted to retain the frame 12.

In the relevant case, the radial spacers are formed as positioning pins 85 having a smooth surface, so that the radial spacers are freely movable along the openings 81. The positioning pins 85 can be fixed by means of locating screws 83 accommodated for this purpose in bores 82. The bores 82 terminate in the openings 81. For the purpose of fixing the positioning pins 85, the locating screws 83 advantageously have a conical shape at their free ends.

Figure 4:
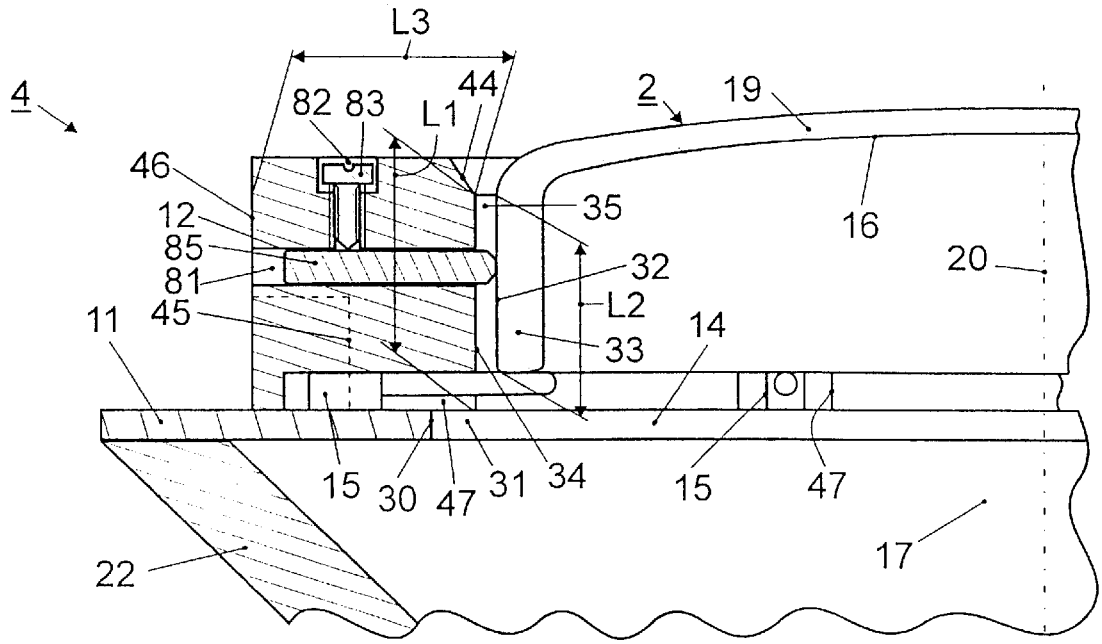
FIG. 4 shows, in analogy with FIG. 3, a part of a device in accordance with a third embodiment of the invention.

In the device 1 shown in FIG. 4, supporting means 15 are provided for supporting and retaining a display screen 2 to be lacquered, which supporting means are arranged on the side of the closing means 11 remote from an inner space 17 of the lacquering head 4. The frame 12 has recesses 47 accommodating a supporting means 15 each. In this way, it is achieved that the supporting means 15 are largely covered by means of the frame 12 and the closing means 11 so that the supporting means 15 are protected from contamination and damage. The frame 12 evenly closes with the side of the closing means 11 remote from the inner space 17 of the lacquering head, noting that, except for the area of the recesses 47, the longitudinal extension L1, extending parallel to the display screen axis 20, of the inner frame boundary face 34 is longer than the extension L2 of the outer peripheral boundary face of the peripheral area 33 of the display screen 2 extending substantially parallel to the display screen axis 20. In the relevant case, the dimension L3 of the frame 12 is chosen to be shorter than the longitudinal extension L1 of the inner frame boundary face 34, which is advantageous with a view to an embodiment saving space in radial directions.

Figure 5:
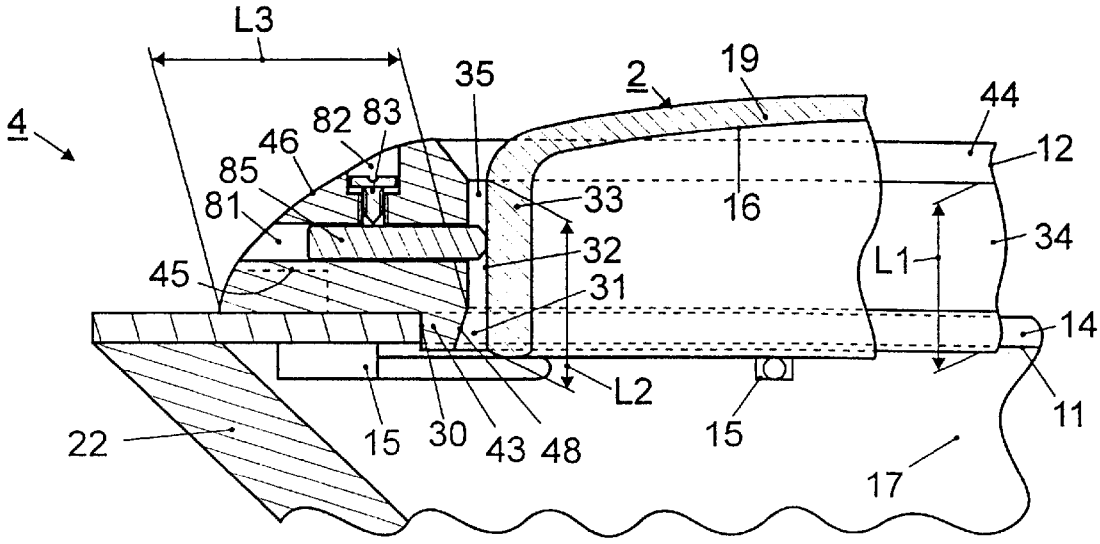
FIG. 5 shows, in analogy with FIGS. 3 and 4, a part of a device in accordance with a fourth embodiment of the invention.

In the device 1 shown in FIG. 5, the frame 12 has a curved outer frame boundary face 46 so that, as compared with a frame 12 having a rectangular cross-section, substantially improved air stream ratios are obtained in the area of the air gap 35 during a rotation of the lacquering head 4. Furthermore, the provision of a curved outer frame boundary face 46 results in a clear reduction of weight of the frame 12 as compared with a frame 12 having a rectangular cross-section. To ensure a sufficiently high stability of the frame 12, the dimension L3 of the frame 12 is chosen to be larger in the relevant case than the longitudinal extension L1 of the inner frame boundary face 34. Furthermore it is to be noted that, in the frame 12, the projection 42 of the frame 12 has an outlet chamfer 48 in the area of the inner frame boundary face 34 facing the inner space 17, so that the advantage is obtained that, during a lacquering process, lacquer which has deposited on the lower side of the screen because of the centrifugal force is spun from the lower side of the screen onto the outlet chamfer 48 of the frame 12 and, because of the outlet chamfer 48, is urged towards the lacquering head part 22 where it is deposited and from where the superfluous lack can drip off. By permanently removing superfluous lacquer from the end area of the frame 12, a contamination of the frame 12 and, consequently, an unwanted closure of the air gap 35 by drying superfluous lacquer is avoided.

Figure 6:
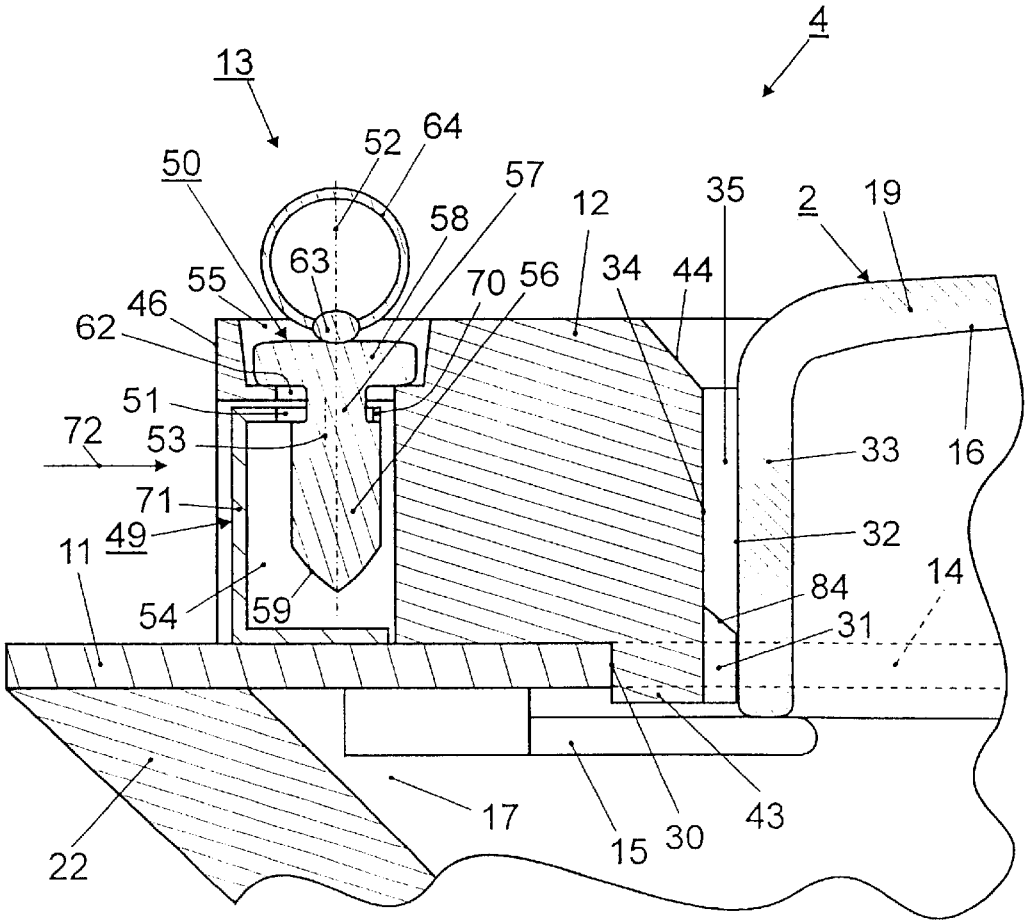
FIG. 6 shows, in analogy with FIGS. 3, 4 and 5, but in a different cross-section through a quick-release connection, a part of a device in accordance with a fifth embodiment of the invention.

In the device 1 shown in FIG. 6, two quick-release connections 13 for securing the frame 12 to the closing means 11 are provided, only one of which quick-release connections 13 is shown in FIG. 6. The quick-release connection 13 is constructed by way of a locking clip 49 and a locking pin 50 and provides the possibility of fixing and releasing the frame 12 onto and from the closing means 11 in a simple and rapid way without the use of additional means.

The locking clip 49 is connected to the closing means 11, namely on the side of the closing means 11 remote from the inner space 17 of the lacquering head 4. The locking clip 49 is substantially U-shaped and is resilient so that the leg 70 of the locking clip 49 which is free from the closing means 11 can be adjusted against the resilient force transverse to the direction of the web 71 of the locking clip 49. The locking clip 49 is provided with a circular clip aperture 51 in the area of its free leg 70, which aperture is provided to accommodate the locking pin 50. The locking pin 50 has a pin axis 52. The clip aperture 51 has an aperture axis 53. In the locking position shown in FIG. 6, the aperture axis 53 and the pin axis 52 extend eccentrically to each other.

The locking pin 50 has a head part 58 and a base part 56 as well as an intermediate part 57 having a reduced diameter. The base part 56 is conical at its free end 59.

The frame 12 has a free space 54 for the locking clip 49, terminating in the outer frame boundary face 46, so that the locking clip 49 is easily accessible. Furthermore, the frame 12 has an indentation 55 for accommodating the head part 58 of the locking pin 50. The indentation 55 of the frame 12 communicates with the free space 54 through a passage 62, whose diameter is smaller than the diameter of the head part 58 of the locking pin 50.

To provide the locking pin 50, it is inserted with its base part 56 into the front end of the indentation 55 and the passage 62. The base part 56 thereby penetrates the clip aperture 51, whereby the locking clip 49 in the area of its free leg 70 is adjusted via the free end 59 and subsequently via the base part 56 against the resilient force in the direction indicated by an arrow 72. After the base part 56 has been completely passed through the clip aperture 51, the intermediate part 57 connected to the base part 56 allows the locking clip 49 to spring back to its original position. In this position, the free leg 70 grips the base part 56 from behind so that the frame 12 is then securely retained on the closing means 11.

It is to be noted that the locking pin 50 has an intermediate piece 63 which is secured to its head part 58 and can be rotated with respect to the pin axis 52, with which intermediate piece a manipulation ring 64 is connected which is adapted to manually or machine-manipulate (insert and remove) the locking pin 50.

To release the mechanically locked connection between the locking pin 50 and the locking clip 49 and thus between the frame 12 and the closing means 11, i.e. for the purpose of unlocking, a pressure is exerted by hand or by machine on the web 71 of the locking clip 49 in the direction of the arrow 72, which results in a readjustment of the free leg 70 so that the locking pin 50 can be subsequently removed by pulling the manipulation ring 64.

In the relevant case, radial spacers are provided, which are formed as positioning lugs 84 which are connected to the frame 12 and, in the area of the projection 43, are distant from the inner frame boundary face 34 towards the outer peripheral boundary face 32 of a display screen 2 and thus come into contact with this display screen 2. The positioning lugs 84 may be fixedly or detachably connected to the frame 12. In this respect, it is to be noted that such positioning lugs may also be connected to the frame 12 in one piece. However, it is further to be noted that such positioning lugs may also be connected to the closing means 11 or to the lacquering head part 22. The deep position, shown in FIG. 6, of the radial spacers formed in this case by positioning lugs 84 has proved to be very advantageous because a display screen 2, placed on the lacquering head 4, does not come into an effective contact with the radial spacers until the end of its placing movement.

The invention is not limited to the embodiments described hereinbefore. In a device 1 according to the invention, for example, also a frame 12 may be provided in which the longitudinal extension L1 along the frame-shaped inner frame boundary face 34 is not constant but increases from the frame corner areas so as to ensure a height adaptation of the frame 12 to an increase of the extension L2 possibly present between the display screen corner areas and along the frame-shaped outer peripheral boundary face 32 of the peripheral area 33 of a display screen 2, so that an advantageous adaptation of the variation of the inner frame boundary face 34 to the variation of the outer peripheral boundary face 32 is obtained. The radially external circumferential boundary of a frame 12 may be rectangular, as is disclosed in the devices in accordance with the above-mentioned embodiments, but it may also be circular.

In the devices in accordance with the above-mentioned embodiments, the frame 12 is made of a synthetic material, advantageously a synthetic material which is resistant to toluene. However, a frame 12 may also be made of a material having a high mechanical stability, for example, metal, for the purpose of achieving a substantially equally high mechanical stability as in a frame made of synthetic material and having smaller dimensions, so that the desired object is achieved, particularly with a smaller dimension L3 transverse to the inner frame boundary face 34.

It is further to be noted that in a device 1 according to the invention, which instead of at least one rotatable lacquering head 4 has at least one stationary lacquering head 4, a circular jet nozzle for supplying a circular jet of lacquer has been found to be favorable as a lacquering nozzle 42.

What is claimed is:

1. A method of lacquering the inner side of display screen, comprising the steps of:

supporting the display screen on a lacquering head;

sealing an inner space of the lacquering head at least in part by surrounding the display screen with a frame to define an air gap between the display screen and the frame;

sizing the air gap to resist an escape of a gaseous medium from the inner space of the lacquering head; and applying lacquer to the inner side of the display screen from the interior of the lacquering head.

2. The method of claim 1 including a step of fixing a position of the display screen relative to the lacquering head throughout an application of lacquer to the display screen.

3. The method of claim 1 wherein said sizing step includes a step of positioning spacers in contact with the display screen.

4. The method of claim 3 wherein said sizing step includes a step of setting an air gap height as a function of display screen size.

5. The method of claim 4 wherein said sizing step includes a step of setting an air gap width between 0.5 mm and 2.5 mm.

6. The method of claim 1 wherein said sizing step includes a step of setting an air gap height as a function of display screen size.

7. The method of claim 6 wherein said sizing step includes a step of setting an air gap width between 0.5 mm and 2.5 mm.

8. The method of claim 1 wherein said sizing step includes a step of setting an air gap width between 0.5 mm and 2.5 mm.

9. A method of lacquering the inner side of a display screen having a front area that extends substantially transverse to a display screen axis, and a peripheral area that extends substantially parallel to the display screen axis, said peripheral area being bounded by an outer peripheral boundary face, comprising:

positioning the display screen at a lacquering head that encloses an inner space and is closed at the top with a closing plate that has a passage bounded by a passage boundary face wherein said passage can be covered by the display screen while leaving free a spacing between the passage boundary face of the passage in the closing plate and the peripheral area of the display screen covering the passage in the closing plate, and through which passage the inner side of a display screen can be lacquered;

providing inside the lacquering head a support with which a display screen covering the passage in the closing plate can be axially supported, wherein the lacquering head having disposed therein an inner space in which a lacquer-supply gun can be inserted;

providing the lacquering head with a sealing structure that includes an air gap that seals the spacing;

bringing the peripheral area of the display screen adjacent the passage in the closing plate of the lacquering head;

axially supporting the display screen in a lacquering position on the support of the lacquering head, in which position the display screen at least partially covers the inner space of the lacquering head; and after the display screen has reached its lacquering position, supplying lacquer via the lacquer-supply gun to lacquer the inner side of the display screen, during which lacquering operation a gaseous medium is released in the inner space of the lacquering head, and escape of the released gaseous medium from the inner space of the lacquering head is counteracted by the sealing structure with which the lacquering head is provided, wherein said sealing structure including the air gap present between an inner frame boundary face of a frame and an outer peripheral boundary face of the peripheral area of the display screen is formed between the peripheral area of the display screen and the frame associated with the sealing structure and being bounded by the inner frame boundary face, wherein said air gap constitutes a flow resistance as a result of its dimensions and counteracting the escape of the released gaseous medium from the inner space of the lacquering head.

10. The method of claim 9, including:

using radial spacers to radially position the display screen axially supported in its lacquering position by the support for the lacquering head; and forming said air gap transversely to the display screen axis, the air gap having a dimension that remains equal along the entire outer peripheral boundary face of the peripheral area of the display screen.

11. The method of claim 9, including:

forming said air gap to extend parallel to the display screen axis of the display screen covering the passage in the closing plate, a longitudinal extension of said air gap extending parallel to the display screen axis of the display screen.

* * * * *